US005198278A

United States Patent [19]

Sumimoto et al.

[11] Patent Number: 5,198,278

[45] Date of Patent: Mar. 30, 1993

[54] SERVICE MAT WITH DIFFERENTIAL BONDING BETWEEN BACKING AND BASE CLOTH

[75] Inventors: Kazushi Sumimoto; Yuji Nagahama, both of Suita, Japan

[73] Assignee: Duskin Co., Ltd., Osaka, Japan

[21] Appl. No.: 699,652

[22] Filed: May 14, 1991

[30] Foreign Application Priority Data

Jul. 10, 1990 [JP] Japan ..... 2-180491

[51] Int. Cl.[5] ..... B32B 3/02; B32B 27/14

[52] U.S. Cl. ..... 428/95; 428/85; 428/96; 428/198

[58] Field of Search ..... 428/85, 95, 96, 198

[56] References Cited

U.S. PATENT DOCUMENTS

| | | | |
|---|---|---|---|
| 1,726,634 | 9/1929 | Smith | 428/95 X |
| 3,306,808 | 2/1967 | Thompson et al. | 428/96 X |
| 3,535,192 | 10/1970 | Gamble | 428/95 |
| 3,542,632 | 11/1970 | Eickhoff | 428/95 X |
| 3,806,401 | 4/1974 | Brinkhoff et al. | 428/96 |
| 3,920,872 | 11/1975 | Ollinger | 428/198 X |
| 4,069,361 | 1/1978 | Kumar | 428/95 |
| 4,267,220 | 5/1981 | Yagi et al. | 428/96 |
| 4,609,580 | 9/1986 | Rockett et al. | 428/198 |

*Primary Examiner*—George F. Lesmes
*Assistant Examiner*—Terrel Morris
*Attorney, Agent, or Firm*—Sherman and Shalloway

[57] ABSTRACT

In a mat composed of a base cloth, a pile tufted thereto, and a rubber backing applied to the non-pile surface of the base cloth, a cotton-like layer composed of a woven cloth of a polyester textured yarn non-adherent to the rubber and a filament or staple which layer is needle-punched is used. In this mat, weakly adherent regions at which the woven cloth and the rubber portion contact each other and strong adhesive regions at which the cotton-like layer and the rubber portion content each other are formed in dots in a large distribution. Waving deformation during repeated use is prevented.

9 Claims, 1 Drawing Sheet

SERVICE MAT WITH DIFFERENTIAL BONDING BETWEEN BACKING AND BASE CLOTH

BACKGROUND OF THE INVENTION

1. Field of the Invention

This invention relates to a rental mat with the prevention of wavy deformation. More specifically, it relates to a rental mat in which wavy phenomenon on the mat surface is repeatedly prevented even when it is used and regenerated over a long period of time.

2. Description of the Prior Art

Heretofore, to prevent indoor entry of outdoor dusts from shoe bottoms, a dust controlling mat has been widely used. This dust-controlling mat is lent to the consumer for a certain period of time, and after being used as spread in a place where people move in and out, it is recovered and regenerated by washing and treated with oiling agent, etc. It is then again lent to the consumer on a rental system.

The rental mats, as disclosed in Japanese Publication No. 7450/84, are a separate-type in which a mat having a pile is detachably applied to a rubber picture framelike base and an integral-type in which a rubber sheet is cemented to the back of a piled mat. The latter tends to be preferred from the viewpoint of an outward appearance.

Binding is strong and, in usual use and washing, the product is not peeled or damaged. But within a relatively short number of rental cycles, waving occurs at the mat surface. This impairs the commercial value of the rental mat and will reduce the walkability and impair the dust removing property of the mat.

In a conventional integral mat, efforts are being made to strengthen the base cloth and the rubber sheet to prevent the peeling of the mat base and the rubber sheet and drop of the piles during long term use. Since the base cloth is very different from the rubber sheet in chemical composition and properties, during production, use and regeneration, a dimensional difference tends to form and this is liable to cause waving. For example, when a rubber sheet is heat-melted to a base cloth of the mat, the rubber sheet is already elongated by heat and the elongation formed by this heat shrinks after production. A dimensional difference forms between the two, and waving occurs between the two. Furthermore, since the rubber is non-shrinkable at the time of washing, the base cloth shrinks to develop a dimensional difference. Thus, likewise, waving also forms. This dimensional difference likewise occurs under conditions in which heat, light, steam or water are used.

SUMMARY OF THE INVENTION

It is an object of this invention to remove the above defects of the conventional integrated mat, and provide a rental integrated mat in which not only during production but also during use, washing or regeneration the occurrence of waving by dimensional change is prevented.

Another object of the present invention is to provide a rental mat which can prevent the occurence of waving during the preparation, use and regenerating process without causing a peeling of the base cloth of mat and rubber sheet or a falling over of the piles.

According to this invention, there is provided a rental mat with the prevention of waving composed of a base cloth, a pile tufted to the base and a rubber backing applied to the non-pile surface of the base cloth, the base cloth being a composite obtained from a cotton like layer of a woven cloth of a polyester textured yarn non-adherent to the rubber backing and a fiber of a filament-type or a spun-type, the cotton like layer being needle-punched through the woven cloth, the adhesive surface between the rubber backing and the composite having a large distribution in dots of weak adhesive regions at which the woven cloth portion and the rubber portion contact each other and strong adhesive regions at which the needle punched portion and the rubber portion contact each other.

In the rental mat, a base cloth having piles and a rubber sheet are integrated. As one characteristic is to use a cotton-like layer composed of a woven cloth of a polyester textured yarn, particularly a filament like yarn, non-adhesive to the rubber backing and a fiber of the filament-type or spun-type, and the cotton-like layer being a composite obtained by needle-punching the cotton-like layer through the woven cloth.

As the textured yarn non-adhesive to the rubber backing layer, there may be used an ordinary polyester yarn of the filament-type or spun-type. There may be used a yarn coated with a latex or emulsion non-adhesive to NBR of the backing layer, which is adhesive to cover the entire yarn system, or a polyester film-like yarn having good deformability or stretchability and having low adhesiveness to the rubber backing layer. Since no secondary processing is required and the fiber is filmy, invasion into the rubber is less and has lower adhesiveness. From this aspect, a polyester film-like yarn is best.

On the other hand, when a similar to cotton in appearance and feel layer in which the fiber is of filament-type or spun-type is needle-punched through the woven cloth, needle-punching is carried out easily, but also the cotton-like layer is bonded to the woven cloth in a markedly bulky condition. Furthermore, since this cotton-like layer has a very large specific surface area, it adheres to the rubber firmly.

According to this invention, when a base cloth surface having no piles tufted thereto is heat-bonded to a rubber sheet, the adhesive surface between the rubber backing and the base cloth of the composite has a very unique adhesive structure that a weak adhesive regions at which the woven cloth portion contacts the rubber portion and strong adhesive regions at which the needle-punched portion contacts the rubber portion are formed in dots in a large distribution. By this adhesive structure and the properties of the base cloth, a very tough adhesive structure is introduced between the mat pile tufted base cloth and the rubber sheet. When a dimensional difference arises owing to the cause mentioned above between the base cloth and the rubber sheet, peeling occurs between the woven cloth of a polyester textured yarn non-adhesive to the rubber backing and the rubber sheet to relax the dimentional difference and the occurrence of waving is prevented.

| | |
|---|---|
| 1 base cloth; | 2 mat pile; |
| 4 rubber backing; | 5 woven cloth; |
| 6 cotton-like layer; | 7 needle-punching; |
| 8 weakly adhesive regions; | |
| 9 strongly adhesive regions. | |

DETAILED DESCRIPTION OF PREFERRED EMBODIMENT

Figure 1:
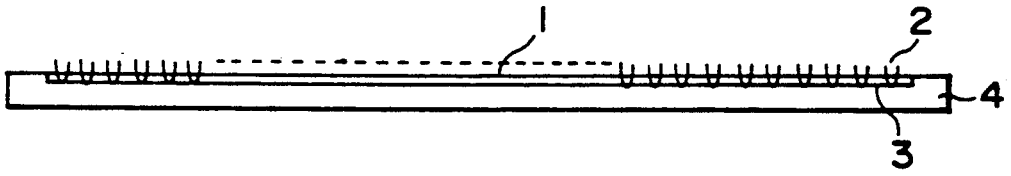
FIG. 1 shows one example of the rental integrated mat of the invention.
Figure 2:
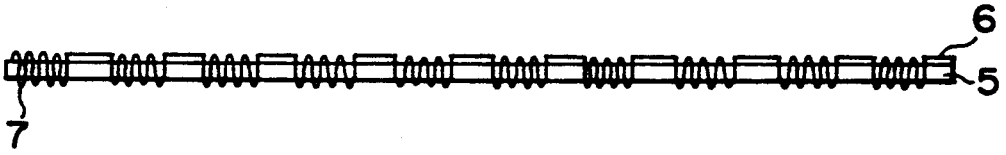
FIG. 2 shows the sectional structure of the base cloth.
Figure 3:
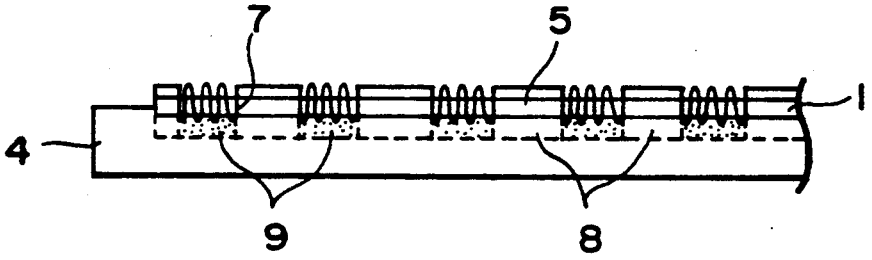
FIG. 3 shows the section of the adhesive surface between the base cloth and the backing.

In FIG. 1 which shows one example of the rental integrated mat is composed of a base cloth 1, a mat pile 2 tufted to the base cloth 1 and a rubber backing 4 applied to the non-pile surface 3 of the base cloth. In FIG. 2 showing the sectional structure of the base cloth, this FIG. 2 shows a cotton-like layer 6 composed of the base cloth 5 of a polyester textured yarn, especially film-like yarn, non-adhesive to the rubber and the fiber of the filament-type or spun-type, the cotton-like layer 6 being needle-punched 7 through the woven cloth. In FIG. 3 illustrating the section of the adhesive layer between the base cloth and backing, weak adhesive regions 8 at which the woven cloth 5 and the rubber portion 4 contact each other and strong adhesive regions 9 at which the needle-punched portion 7 and the rubber portion 4 exist in dots in a large distribution in the adhesive surface between rubber backing 4 and the composite base sheet 1.

Examples of the polyester film-like yarn constituting the base cloth are high-molecular-weight polyesters, especially polyethylene terephthalate, and thermoplastic copolyesters composed mainly of ethylene terephthalate, which are strongly stretched to increase tensile strength and slit to a certain width. This film like yarn may be somewhat fibrilleted, but excessive fibrillation is not preferred. This film-like yarn generally preferably has a thickness of 10 to 5000 μm, and a width of 0.1 to 20 mm.

As a textured yarn to be subjected to a non-tacking treatment, there may likewise be used high-molecular-weight thermoplastic polyesters, especially polyethylene terephthalate, or thermoplastic copolyesters composed mainly of ethylene terephthalate strongly stretched.

The non-adhesive processing of such textured yarns may be treated with a paste used in general sizing such as a latex emulsion non-adhesive to NBR, for example, an acrylic acid ester emulsion, an ethylene acetate emulsion or polyvinylalcohol (PVA) water-soluble resins in an amount of 5% to 30%. If the amount is less than 5%, the fiber cannot be entirely rendered non-tacky. When it is treated in an amount of at least 30%, the tufting property becomes difficult. When the unprocessed yarn is processed into a woven cloth and then treated with the sizing agent, the same effect will be obtained.

The woven texture of the woven cloth is not particularly limited, but it may be sufficiently of a plain weave. If desired, it may be a twill weave and other deformed weaves. The unit weight of the base cloth may vary depending upon the weight of the mat, but generally it may be 30 to 500 g/cm$^2$ preferably. To facilitate needle punching, a lubricant may be included in a textured yarn such as a filmy yarn. Textured yarns such as a filmy yarn may be colored in a desired color of a desired shade.

The cotton-like layer is composed of the same fiber polyester mentioned above composed of a web of the filament-type or spun-type. By overlaying at least one layer of the web on the upper side, the lower side or both, and by needle-punching it by a known means the woven cloth and the cotton-like layer can be integrated. This web is a markedly bulky, and even after needle-punching, its condition is maintained.

The polyester fibers constituting the cotton-like layer should preferably have a single yarn denier of generally 0.5 to 100 denier, especially 3 to 20 denier. The constituent single yarn may be a multi-filament or a staple. The cotton-like layer may preferably be a carding web; or spun bonded web. The unit weight of the cotton-like layer is generally preferably 10 to 300 g/m$^2$. The density of needle punching is at least 1000/m$^2$ to maintain adhesiveness to rubber, and from the viewpoint of punching operation efficiency, it is preferably one million or more to maintain adhesion to the rubber. In the present invention, an ordinary textile fiber may be used as fibers constituting the cotton-like layer, and functional fibers such as water-absorbing fibers, oil-absolbent fibers, electroconductive fibers, anti-bacterial fibers, anti-mold fibers non-odorizing fibers, and aromatic fibers to develop their own functions. For example, by using water-absorbent fibers as the cotton-like layer, the later struck piles are not water-absorbents water-absorbent property may be given without changing the outer appearance.

Examples of the pile yarns to be struck into the base cloth are cotton fiberes, rayon fibers, polyvinyl alcohol fibers, acrylic fibers, nylon fibers, spun yarns composed of one or two or more other synthetic fibers, and multi-filament yarns. Generally the tufted pile length is generally 3 to 20 mm. The type of the pile may be cut piles or loop piles. They may be crimped or uncrimped, and the pile length may be constant or different from each other. For example, they may be, a high cut-low loop. The denier of the piles may be changed greatly and, for example, they may have a pile total denier of 500 to 1,000 denier. The pile stitching condition may be known ones. The stitch may be 4 to 20 per inch. The gauge may be 2 to 20 per inch. Examples of the rubber sheet as a backing may include various elastomers such as nitrile-butadiene rubber (NBR), styrene-butadiene rubber (SBR), chloroprene rubber (CR), polybutadiene (BR), polyisoprene (IIB), butyl rubber, natural rubber, ethylene-propylene rubber (EPR) ethylene-propylene-diene rubber (EPDM), polyurethane, chlorinated polyethylene, chlorinated polypropylene, and soft vinyl chloride resin. From the standpoint of oil resistance and weatherability, the nitrile-butadiene rubber (NBR) is preferred. In the formation of the rubber sheet, known additives, such as sulfur-type or organic vulcanizes, vulcanization accelerators, softening agents, antioxidants, fillers, dispersants, plasticizers and coloring agents may be added in known amounts.

In the production of an integrated mat, the above rubber composition is kneaded by using a roll or a Banbury mixer; this sheet to mold the composition into a sheet is laid over a tufted mat; and it is heated and pressed in a pressure mold and a known suction pressure-reduction mold to perform adhesion and vulcanization simultaneously. To increase adhesion of the rubber sheet to the base cloth, the non-pile surface of the base sheet may be coated with the same latex sheet as the rubber sheet, or may be coated in advance with an adhesive or an adhesion promotor such as ethylene-vinyl acetate. The unit weight of the rubber sheet may be in the range of 500 to 3000 g/m$^2$. The two may be integrated such that the end edge of the rubber sheet may somewhat go outside from the end edge of the base cloth. The vulcanization and adhesion may be carried out at a temperature of 120° to 185° C. under a pressure of 0.5 to 10 kg/mm$^2$.

The pile yarn of the mat of this invention adsorbs dusts adhering to the shoe bottom and holds them. To increase this action further, a dust-adsorbent oil may be coated or impregnated in the pile yarns. Examples of the dust-adsorbent liquid are liquid paraffin, spinolle oil, alkylbenzene oil, diester oils a mineral oil such as castor oil, synthesis oil, vegetable oils, and aqueous dust adsorbents described in Japanese Patent Publications No. 1019/1978 and No. 37471/1978. The amount of the adsorbent applied is generally 20 to 500 g/m$^2$.

EFFECT OF THE INVENTION

According to the present invention by using area woven cloth a composite composed of a cotton-like layer composed of a woven cloth of a polyester textured yarn, especially a filmy yarn, non-tacky to the rubber and a fiber of filament-type or spun-type, in which the cotton-like layer is needle-punched through the woven cloth, when the base cloth obtained by tufting the mat piles and the rubber sheet are heat-melted, a very unique adhesive structure is formed on the adhesive surface between the rubber backing and the base cloth of the composite so that weak adhesive regions at which the base cloth portion contacts the rubber portion and strong adhesive regions at which the needle-punched portion contacts with the rubber portion are formed in dots in a large distribution. By this adhesive structure and the properties of the base cloth of the composite, a firm adhesive structure is introduced between the base cloth obtained by tufting mat piles and the rubber sheet, and when admensional difference occurs by the above cause between the base cloth and the rubber sheet, peeling occurs between the woven cloth of the textured yarn and the rubber sheet to relax the dimensional difference and waving deformation can be prevented.

In the mat of this invention, the base cloth and the rubber are not entirely adhered, but are adhered in evenly distributed dots. Hence, the suppleness of the mat can be ensured, and propensities such as bending curved propensity and winding propensity do not easily show. Thus, the best hand as a rental mat is maintained, and a commercial value can be enhanced. Further since the suppleness is given to the mat, a trouble of the mat moving on the floor surface on walking is effectively removed.

EXAMPLES

EXAMPLE 1

| | |
|---|---|
| Pile | BCF Nylon<br>Stitch 6/inch<br>Gauge 5/32<br>pile height 9 mm<br>Unit Weight 880 g/m$^2$<br>cut pile |
| Base Cloth | |
| (A) | polyester plain weave<br>Unit weight 200 g/m$^2$ |
| (B) | Polyester film yarn plain weave<br>Unit weight 150 g/m$^2$<br>Punching polyester filament yarn<br>Unit weight 120 g/m$^2$<br>Single fiber denier 5 d<br>Density 10000/m$^2$ |
| Precoat NBR latex | 200 g/m$^2$ (solids)<br>Vulcanizing agent (sulfur) 1% by weight incorporated |

A mat of the above materials was prepared and the pre-coat layer was dried at 150° C. for 20 minutes.

These mats A and B were cut to 70×85 cm and integrated mats were formed by the following procedure.

On an unvulcanized NBR sheet having a thickness of 4 mm having vulcanizer (sulfur), 1% by weight and a vulcanization promoter (2-mercapto benzothiazole), 1% by weight, incorporated therein. The mat cut to the above-size and pressed at 150° C. for 15 minutes under a pressure of 5 kg/cm$^2$ to form vulcanization and adhesion and to prepare nylon pile integrated mats A and B.

These mats were laid for 3 days in a place having 3000 pedestrains/day, and the mats were washed and regenerated in a customary manner.

This operation was repeated 20 times, and the pile removing strength and the base cloth-rubber adhesion strength was were measured. The results are shown in Table 1.

Table 1 also shows the degree of waving of the mat by the waving height (mm) and the number before use and after 20 rental mat washing and regeneration. The yarn pulling strength and the adhesion strength (between the base cloth the rubber) were carried out in accordance with the pile yarn pull strength and the peel strength of the liner in JIS L 1021.

EXAMPLE 2

| | |
|---|---|
| Pile | Vinylon 100% |
| Stitch | 8.5/inch |
| Gauge | ½ |
| Pile height | 10 mm |
| Unit weight | 800 g/m$^2$ |
| Base Cloth | |
| (C) | Polyester plain weave<br>Unit weight 120 g/cm$^2$ |
| (D) | Polyester film yarn plain weave<br>Unit weight 150 g/m$^2$<br>Punching-Polyester Spun yarn<br>Unit weight 120 g/m$^2$<br>Single Yarn denier 3d<br>Punching density 15000/m$^2$ |
| Pre-coat | NBR latex<br>60 g/m$^2$ solids)<br>Cross-linking agent Water-soluble melamine resin 3% by weight |

The pre-coat layers of the above materials were dried at 150° C. for 10 minutes in the same way as in Example 1 to prepare integrated mats C and D. The same test as in Example 1 was conducted on these mats to measure the pile palling strength. The results of the measurement are shown in Table 1.

EXAMPLE 3

| | |
|---|---|
| Pile | Acrylic fibers 100%<br>Stitch 8.5/inch<br>Gauge 5/32<br>Pile height 10 mm<br>Unit weight 700 g/m$^2$ |
| Base cloth | |
| (E) | Polyester plain weave<br>Unit weight 130 g/m$^2$ |
| (F) | Polyester film yarn plain weave |

-continued

| | |
|---|---|
| | Unit weight 130 g/m$^2$ |
| | Punching-polyester filament yarn |
| | Unit weight 120 g/m$^2$ |
| | Single yarn denier 30 d |
| | Punching density 2000/m$^2$ |
| Pre-coat | None |

The above mentioned of the mats were prepared in the same way as in Example 1 to prepare mats E and F. The mats were tested as in Example 1 to measure the pile yarn removing strengths. The results are shown in Table 1.

TABLE 1

| | Example 1 | | Example 2 | | Example 3 | |
|---|---|---|---|---|---|---|
| Integrated mat No. | A | B | C | D | E | F |
| Yarn pulling strength | | | | | | |
| Before use (kg) | 10.3 | 10.1 | 9.5 | 9.3 | 8.5 | 8.7 |
| After 20 times washing and regeneration of the rental mat | 9.5 | 9.7 | 8.5 | 8.8 | 6.8 | 7.2 |
| Adhesion strength | | | | | | |
| Before use (kg) | 9.5 | 10.8 | 8.5 | 11.2 | 6.2 | 10.2 |
| After 20 times washing and regeneration of the rental mat | 8.3 | 10.5 | 7.8 | 10.8 | 5.2 | 9.8 |
| Waving | | | | | | |
| Before use (mm) | 0 | 0 | 0 | 0 | 0 | 0 |
| After 20 times washing and regeneration of the rental mat | 10 mm 5 | 0 | 7 mm 6 | 0 | 5 mm 12 | 0 |

As shown in Examples 1 to 3, the adhesion strength between the original cloth and the rubber portion and the yarn pulling strength were good when any fibers were used, and the waving could be prevented.

What is claimed is:

1. A dusting mat comprising:

a base cloth having a first surface and a second surface;

a mat pile tufted to said first surface of said base cloth;

a rubber backing applied to said second surface of said base cloth;

said base cloth being a composite of (i) a woven cloth of a polyester yarn non-adherent to said rubber backing and (ii) a web of fiber adherent to said rubber backing;

said web being needle-punched through said woven cloth;

whereby an adhesive surface between said base cloth and said rubber backing has a structure wherein weak adhesion occurs where said woven cloth contacts said rubber backing and strong adhesion occurs wherein said needle-punched web contacts said rubber backing.

2. The dusting mat of claim 1, wherein said polyester yarn of said woven cloth is a film yarn.

3. The dusting mat of claim 2, wherein said film yarn has a thickness of 20 to 5000 μm and a width of 0.1 to 20 mm.

4. The dusting mat of claim 1, wherein said polyester yarn of said woven cloth is a stretched thermoplastic polyester yarn coated with an emulsion of a sizing agent non-adherent to said rubber backing.

5. The dusting mat of claim 1, wherein said woven cloth has a unit weight of 30 to 500 g/m$^2$.

6. The dusting mat of claim 1, wherein said web is a carding web or a spun-bonded web of a polyester fiber having single yarn denier of 0.5 to 100 denier.

7. The dusting mat of claim 1, wherein said web has a unit weight of 10 to 300 g/m$^2$.

8. The dusting mat of claim 1, wherein the needle-punching density is 1,000 to 1,000,000 per m$^2$.

9. The dusting mat of claim 1, wherein said rubber backing comprises a nitrile-butadiene rubber.

* * * * *